US005199654A

United States Patent [19]

Fulghum, Sr.

[11] Patent Number: 5,199,654

[45] Date of Patent: Apr. 6, 1993

[54] MATERIAL AND AIR DEFLECTOR FOR FEED CHUTE

[75] Inventor: G. Heyward Fulghum, Sr., Wadley, Ga.

[73] Assignee: Fulghum Industries, Inc., Wadley, Ga.

[21] Appl. No.: 899,887

[22] Filed: Jun. 17, 1992

[51] Int. Cl.[5] ..... B02C 9/04

[52] U.S. Cl. ..... 241/74; 144/162 R; 144/174; 241/37.5; 241/92

[58] Field of Search ..... 144/162 R, 172, 174, 144/180; 241/37.5, 66, 70, 71, 73, 74, 81, 92, 101.7

[56] References Cited

U.S. PATENT DOCUMENTS 266,857 10/1882 McKenna .
1,323,461 12/1919 Ervin .
2,491,661 12/1949 Gruendler .
3,756,519 9/1973 Reynolds .
4,143,823 3/1979 Judson .
4,595,148 6/1986 Luerken .
4,607,799 8/1986 Currie .
4,824,034 4/1989 Baker .
4,834,302 5/1989 Baker .
5,035,367 7/1991 Nojima .

*Primary Examiner*—W. Donald Bray
*Attorney, Agent, or Firm*—Cushman, Darby & Cushman

[57] ABSTRACT

An infeed chute with a material and air deflector is provided for a shredding device such as a bark hog. The infeed chute is attached to the inlet of the cutting device and a material and air deflector is defined therein for preventing material from being ejected out of the infeed chute by the cutting blades without substantially obstructing material inflow. The material and air deflector is attached to the inside of the infeed chute and includes a flat plate upstream deflector surface and a curved downstream deflector surface. The deflector surfaces extend across the infeed chute to define a substantially tortuous path between the inlet and outlet of the infeed chute to prevent material ejected by the cutting device from leaving the inlet of the infeed chute or from obstructing infeed flow.

7 Claims, 1 Drawing Sheet

MATERIAL AND AIR DEFLECTOR FOR FEED CHUTE

BACKGROUND OF THE INVENTION

1. Field of the Invention

The present invention relates to a feed chute, and, more particularly, to a deflector for an infeed chute for a bark hog.

2. Description of the Related Art

A major by product of wood processing in wood yards, chip mills and pulp mills is wood scraps and bark. One use of these scraps and bark is as fuel for wood-fired boilers. Bark and like scraps which are collected in particular, from log barkers are conventionally conveyed away from the main wood processing line and processed further as necessary to produce suitable fuel for wood fired boilers. Typically that further processing includes cutting the bark and scraps into small pieces. One such cutting processor is known as a bark hog. Exemplary bark hog includes three main sections: a drop feed opening to intake bark and scraps; a processor; and a bottom discharge. By way of example, the drop feed material opening can be on the order of $1\frac{1}{2}' \times 2'$ to $1\frac{1}{2} \times 4'$. The bark hog processor may be a $2' \times 2'$ drum equipped with 24 $2\frac{1}{8}''$ chipping blades. The large drop feed material opening allows this machine a large processing capacity which advantageously can keep up with the parallel wood processing activities of the chip mill or the like.

The scraps and bark are typically conveyed to the vicinity of the bark hog with an infeed conveyor and fed into the bark hog via an infeed chute. Because of the relatively large material opening of the bark hog, the infeed chute must have an outlet of sufficient size to direct material along and across the length of the cutting drum of the hog. Furthermore, the infeed chute must have a mouth large enough to receive the material from an infeed conveyor. Because of the large inlet and outlet of the infeed chute, bark and scraps can be ejected, by the rotating blades of the hog, back up into and out of the infeed opening of the chute thus decreasing the efficiency of the hog and endangering the workers in the vicinity of the material feed-chute.

SUMMARY OF THE INVENTION

To minimize ejection of scraps back out through the chute in accordance with the invention, a material and air deflector is provided within the infeed chute. The deflector advantageously improves the efficiency and safety of conventional infeed chute systems by preventing material from being ejected out through the inlet of the infeed chute. The deflector redirects ejected material without obstructing the flow of material from the infeed conveyor into the infeed chute or delivery of material from the chute into the hog. More particularly, the deflector defines a tortuous path through the infeed chute which allows reliable infeed from the large chute inlet to the large chute outlet but intersects all direct paths from the blades of the bark hog to the inlet. This prevents material which re-enters the chute from reaching the inlet, or otherwise interfering with the normal flow of material through the chute and from risking the safety of workers in the vicinity of the infeed chute.

Other objects, features and characteristics of the present invention as well as the methods of operation and functions of the related elements of the structure and the combination of parts and economies of manufacture will become more apparent upon consideration of the following description and the appended claims with reference to the accompanying drawings, all of which form a part of this specification wherein like reference numerals designate corresponding parts in the various figures.

DETAILED DESCRIPTION OF THE PRESENTLY PREFERRED EXEMPLARY EMBODIMENT

Figure 1:
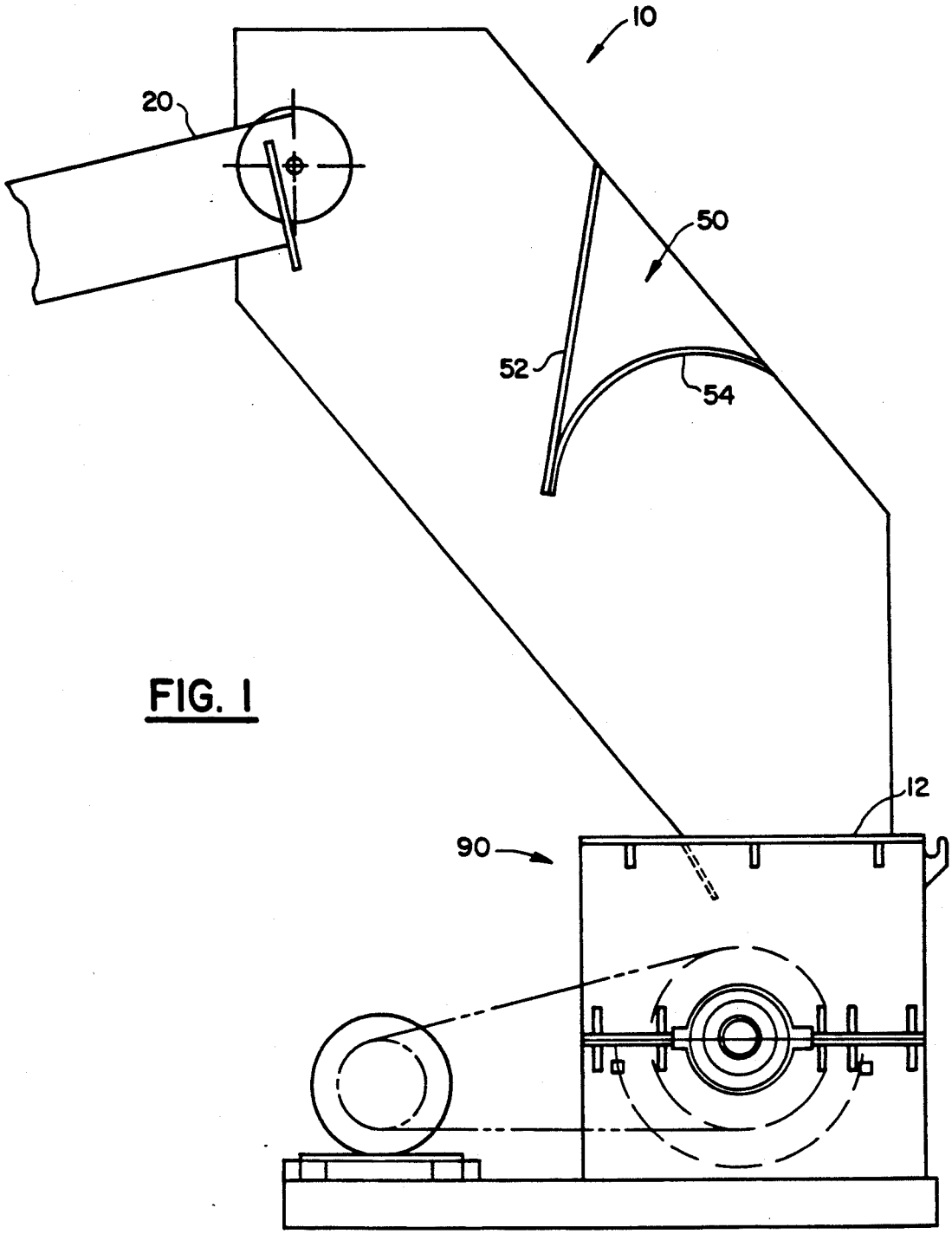
FIG. 1 is a schematic vertical cross-section of a bark hog and infeed chute having a material and air deflector therein in accordance with the present invention.

In accordance with the present invention, a material in feed chute 10 is mounted to a conventional bark hog 90 such that its outlet 12 is aligned with the inlet of the hog 90. In the illustrated embodiment, bark and like scraps are conveyed via an infeed conveyor 20 and deposited in infeed chute 10. It is to be appreciated that materials to be shredded in bark hog 90 can be loaded into the infeed chute as discreet loads as well as continuously conveyed thereto, and that bark can be conveyed or discretely loaded into a top infeed chute rather than a side infeed chute as illustrated. The advantages of the present invention can be most fully appreciated, however, where a side infeed chute is provided because the chute protects the interior of bark hog 90 from inclement weather.

The material and air deflector 50 provided in accordance with the invention is mounted within infeed chute 10 to extend from side to side and from the rear wall towards the front wall so as to define a gap across the width of the chute along the length of the hog.

Material and air deflector 50 includes an upstream, substantially planer deflector surface 52 to guide and direct inflow material toward the gap and to hog 90. Thus, as can be seen in FIG. 1, infeed conveyor 20 conveys bark into the interior of infeed chute 10. The bark drops from the end of conveyor 20 and is deposited into chute 10. The material moves down through the chute under the influence of gravity and easily passes through the gap between the free edge of material and air deflector 50 and the inclined lower wall of feed chute 10.

In order to encourage bark and like materials fed into the chute to flow rapidly through the gap defined by material deflector 50 and the walls of the chute, upstream deflector surface 52 of material and air deflector 50 may be a flat plate so as to avoid introducing any turbulent reverse flow in a direction counter to the main flow of the material. In the illustrated embodiment, upstream deflector surface 52 is offset slightly from vertical to encourage smooth flow of the bark and to minimize obstruction of flow at the upper end of infeed chute 10.

Material and air deflector 50 also includes a downstream deflector surface 54. This surface intercepts and redirects material ejected from hog 90 back into the inlet of the hog. Downstream deflector surface 54 is curved to more smoothly redirect material into the infeed flow path. The curved surface also advantageously recirculates the turbulent air flow of the bark hog 90 to help redirect ejected scraps back into the hog.

In the event the cutting blades of hog 90 eject bark or other material fragments back into infeed chute 10, even at high velocity, the smooth and arcuate downstream deflector surface 54 of material and air deflector 50 blocks such deflected material and aligns and directs that material to re-enter the infeed material stream which is flowing through the gap. In order to insure that, despite its trajectory, bark and like scraps ejected from hog 90 cannot reach the inlet opening of infeed chute 10, material deflector 50 extends across infeed chute 10 such that a straight line flow path between the outlet end of infeed conveyor 20 and the inlet to the bark hog 90 essentially does not exist. In the illustrated embodiment, material and air deflector 50 intersects or nearly intersects a straight line which may be drawn between the blades of bark hog 90 and the end of infeed conveyor 20. Thus deflector 50 will substantially prevent any ejected bark from reaching the inlet of material infeed chute 10, thus minimizing obstructions to infeed flow of material, increasing the processing efficiency of hog 90, and reducing the safety hazards to nearby workers.

In the illustrated embodiment, only a single material and air deflector is shown in the flow path of the feed chute. It is to be appreciated, however, that to ensure a sufficiently tortuous path for the bark, two or more deflectors may be provided. Preferably each such material and air deflector has an arcuate lower surface to redirect and return projected material and a flat appropriately inclined upper surface to encourage material flow along the shortest path possible through the infeed chute to the bark hog.

While the invention has been described in connection with what is presently considered to be the most practical and preferred embodiment, it is to be understood that the invention is not to be limited to the disclosed embodiments, but, on the contrary, is intended to cover various modifications and equivalent arrangements included within the spirit and scope of the appended claims.

What is claimed is:

1. A material feed chute for a cutting device having side walls, an inlet opening for receiving material and an outlet opening in flow connection with a feed inlet of the cutting device, said side walls defining a flow passage from said inlet to said outlet and a material and air deflector defined within the chute between the inlet and outlet openings, said material and air deflector comprising:

an upstream deflector portion to direct material flowing through the chute towards the cutting device; and a downstream deflector portion having a curved surface for intercepting and recirculating material ejected from the cutting device back toward the cutting device.

2. The material feed chute of claim 1 wherein the upstream deflector portion comprises a flat plate extending across a portion of the flow passage so as to constrict the material flow path through said chute.

3. The material feed chute of claim 2, wherein the flat plate is inclined at an angle with respect to a vertical plane.

4. The material feed chute of claim I wherein the upstream deflector portion extends more than about one half of the diameter of said flow passage.

5. The material feed chute of claim 1 wherein the downstream deflector portion has a downstream surface describing an arc for recirculating air and ejected material toward said outlet opening.

6. The material feed chute of claim 1, wherein the downstream deflector portion is a curved plate which extends across at least about one half of the diameter of said flow passage.

7. The material feed chute of claim 1, wherein the material and air deflector extends across the flow passage so as to intersect substantially all straight line paths between the outlet opening and a locus of material deposition in the feed chute.

* * * * *